US010515599B2

(12) United States Patent
Huang

(10) Patent No.: US 10,515,599 B2
(45) Date of Patent: Dec. 24, 2019

(54) DISPLAY PANEL HAVING ADJUSTABLE COMMON VOLTAGE AND METHOD OF DRIVING THE SAME

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventor: Jiacheng Huang, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 235 days.

(21) Appl. No.: 14/907,218

(22) PCT Filed: Jul. 22, 2015

(86) PCT No.: PCT/CN2015/084783
§ 371 (c)(1),
(2) Date: Jan. 22, 2016

(87) PCT Pub. No.: WO2016/155157
PCT Pub. Date: Oct. 6, 2016

(65) Prior Publication Data

US 2016/0293125 A1 Oct. 6, 2016

(30) Foreign Application Priority Data

Mar. 31, 2015 (CN) ..... 2015 1 0147865

(51) Int. Cl.
*G09G 3/36* (2006.01)

(52) U.S. Cl.
CPC ..... *G09G 3/3614* (2013.01); *G09G 3/3655* (2013.01); *G09G 3/3688* (2013.01);
(Continued)

(58) Field of Classification Search
CPC ..... G02F 1/136259
See application file for complete search history.

(56) References Cited

U.S. PATENT DOCUMENTS 5,926,161 A * 7/1999 Furuhashi ..... G09G 3/3648 345/100
2002/0018035 A1 2/2002 Song et al.
(Continued)

FOREIGN PATENT DOCUMENTS

CN 101174397 5/2008
CN 102081245 6/2011
(Continued)

OTHER PUBLICATIONS

Decision on Rejection in Chinese Application No. 201510147865.5 dated Apr. 7, 2017, with English translation. 10 pages.
(Continued)

*Primary Examiner* — Stephen S Hong
*Assistant Examiner* — Richard M Russell
(74) *Attorney, Agent, or Firm* — Womble Bond Dickinson (US) LLP

(57) ABSTRACT

The present invention provides a display panel and a driving method thereof, as well as a liquid crystal display device, which relates to the field of liquid crystal display technology, and can reduce the power consumption of the display panel. The display panel comprises a source driver, a plurality of pixel units defined by a plurality of gate lines and a plurality of data lines arranged crossly, and a common voltage output driver, the common voltage output driver is used for, at a Nth frame, inputting a negative common voltage to a first pixel
(Continued)

unit, and at an adjacent frame of the Nth frame, inputting a positive common voltage to the first pixel unit, the first pixel unit is one of the plurality of pixel units, N is a positive integer; the source driver is used for, when the common voltage output driver inputs the negative common voltage to the first pixel unit, inputting a data voltage greater than or equal to the negative common voltage to the first pixel unit, and, when the common voltage output driver inputs the positive common voltage to the first pixel unit, inputting a data voltage less than or equal to the positive common voltage to the first pixel unit. The display panel can be applied in a liquid crystal display device.

12 Claims, 6 Drawing Sheets

(52) U.S. Cl.
CPC ..... *G09G 3/3696* (2013.01); *G09G 2310/027* (2013.01); *G09G 2310/0213* (2013.01); *G09G 2310/0291* (2013.01); *G09G 2310/0297* (2013.01); *G09G 2310/08* (2013.01); *G09G 2330/021* (2013.01)

(56) References Cited

U.S. PATENT DOCUMENTS

2005/0088392 A1* 4/2005 Kim ..... G09G 3/3655 345/94
2007/0085805 A1* 4/2007 Ishii ..... G02F 1/136259 345/98
2007/0164963 A1 7/2007 Kim et al.
2008/0266222 A1 10/2008 Feng
2011/0128272 A1 6/2011 Chen et al.
2012/0113084 A1* 5/2012 Yang ..... G09G 3/3655 345/212

FOREIGN PATENT DOCUMENTS

CN 104698645 6/2015
JP 2009223167 10/2009

OTHER PUBLICATIONS

International Search Report and Written Opinion with English Language Translation, dated Dec. 1, 2015, Application No. PCT/CN2015/084783.

Chinese Office Action with English Language Translation, dated Feb. 1, 2016, Chinese Application No. 201510147865.5.

Office Action in Chinese Application No. 201510147865.5 dated Sep. 23, 2016, with English translation. 6 pages.

Supplementary European Search Report and Written Opinion received for EP Patent Application No. 15834706.2, dated Sep. 14, 2018, 10 pages.

* cited by examiner

| | | | | | | | | |
|---|---|---|---|---|---|---|---|---|
| + | − | + | − | + | − | + | − | + |
| − | + | − | + | − | + | − | + | − |
| + | − | + | − | + | − | + | − | + |
| − | + | − | + | − | + | − | + | − |
| + | − | + | − | + | − | + | − | + |
| − | + | − | + | − | + | − | + | − |
| + | − | + | − | + | − | + | − | + |
| − | + | − | + | − | + | − | + | − |
| + | − | + | − | + | − | + | − | + |

DISPLAY PANEL HAVING ADJUSTABLE COMMON VOLTAGE AND METHOD OF DRIVING THE SAME

FIELD OF THE INVENTION

The present invention relates to the field of liquid crystal display technology, particularly to a display panel and a driving method thereof, as well as a liquid crystal display device.

BACKGROUND OF THE INVENTION

With the continuous development of the liquid crystal display technology, the liquid crystal display device has been more and more widely applied. During operation of the liquid crystal display device, the display is generally accomplished by rotation of the liquid crystal molecules driven by a voltage difference (i.e., a driving voltage) of the data voltage outputted by the source driver and the common voltage outputted by the common voltage output driver. In order to avoid the liquid crystal molecules from being driven by a certain fixed driving voltage for a long time, and the rotational characteristic of the liquid crystal molecules from being destroyed, the polarity (including positive polarity and negative polarity) of the driving voltage needs to be reversed generally, i.e., the polarity of the driving voltage varies alternately between the positive polarity and the negative polarity. As shown in FIG. 1, when the data voltage is higher than the common voltage, the polarity of the driving voltage is positive polarity, vice versa, the polarity of the driving voltage is negative polarity.

During operation of the liquid crystal display device, since the common voltage outputted by the common voltage output driver is generally a constant voltage, in order to ensure polarity of the driving voltage of the liquid crystal molecules to be reversed, the variation range of the data voltage has to be twice of the driving voltage, for example, if the driving voltage is V0, the variation range of the data voltage is 2V0.

In order to ensure the source driver to output the data voltage normally, the maximum working voltage of the source driver has to be 2V0, hence, the maximum working voltage of the display panel has to be 2V0, i.e., the maximum working voltage of the display panel is twice of the driving voltage of the liquid crystal molecules, such that the actual power consumption of the display panel would be twice of the theoretical power consumption.

SUMMARY OF THE INVENTION

The present invention provides a display panel and a driving method thereof, as well as a liquid crystal display device, which can reduce the power consumption of the display panel.

In order to achieve the above purpose, the present invention adopts the following technical solutions:

The present invention provides a display panel comprising a source driver and a plurality of pixel units defined by a plurality of gate lines and a plurality of data lines arranged crossly, wherein the display panel further comprises a common voltage output driver, the common voltage output driver is used for, at a Nth frame, inputting a negative common voltage to a first pixel unit, and at an adjacent frame of the Nth frame, inputting a positive common voltage to the first pixel unit, the first pixel unit is one of the plurality of pixel units, N is a positive integer;

the source driver is used for, when the common voltage output driver inputs the negative common voltage to the first pixel unit, inputting a data voltage greater than or equal to the negative common voltage to the first pixel unit, and, when the common voltage output driver inputs the positive common voltage to the first pixel unit, inputting a data voltage less than or equal to the positive common voltage to the first pixel unit.

Optionally, the common voltage output driver is further used for receiving a polarity control signal, a logic level of the polarity control signal at the Nth frame is contrary to a logic level of the polarity control signal at the adjacent frame of the Nth frame;

wherein, at the Nth frame, when the polarity control signal is of a high level, the common voltage output driver inputs the negative common voltage to the first pixel unit, and at the adjacent frame of the Nth frame, when the polarity control signal is of a low level, the common voltage output driver inputs the positive common voltage to the first pixel unit; or at the Nth frame, when the polarity control signal is of a low level, the common voltage output driver inputs the negative common voltage to the first pixel nit, and at the adjacent frame of the Nth frame, when the polarity control signal is of a high level, the common voltage output driver inputs the positive common voltage to the first pixel unit.

Optionally, the polarity control signal comprises a first polarity control signal for controlling output of the common voltage output driver in pixel units of odd rows and pixel units of even rows, a logic level of the first polarity control signal in the pixel units of odd rows is contrary to a logic level of the first polarity control signal in the pixel units of even rows within the same frame, or, the polarity control signal comprises a second polarity control signal for controlling output of the common voltage output driver in pixel units of odd rows and a third polarity control signal for controlling output of the common voltage output driver in pixel units of even rows, a logic level of the second polarity control signal is contrary to a logic level of the third polarity control signal within the same frame, the logical levels of the second polarity control signal and the third polarity control signal are contrary within two adjacent frames;

the common voltage output driver comprises a plurality of groups of output terminals, each group of output terminals comprise an odd output terminal and an even output terminal respectively, wherein when the odd output terminal outputs a negative common voltage, the even output terminal outputs a positive common voltage, or, when the odd output terminal outputs a positive common voltage, the even output terminal outputs a negative common voltage;

in the plurality of pixel units, pixel units of odd columns in each row of pixel units are connected with an odd output terminal in a corresponding group of output terminals of the common voltage output driver respectively, pixel units of even columns in each row of pixel units are connected with an even output terminal of the corresponding group of output terminals of the common voltage output driver respectively.

Optionally, the polarity control signal is used for controlling output of the common voltage output driver in pixel units of odd rows and pixel units of even rows, the logical level of the polarity control signal is contrary within two adjacent frames, the common voltage output driver comprises a plurality of groups of output terminals, each group of output terminals comprises an odd output terminal and an even output terminal respectively, wherein, when the odd output terminal outputs a negative common voltage, the even output terminal outputs a positive common voltage, or, when the odd output terminal outputs a positive common voltage, the even output terminal outputs a negative common voltage;

in the plurality of pixel units, pixel units of odd columns in one row of pixel units of any two adjacent rows of pixel units are connected with an odd output terminal in a corresponding group of output terminals of the common voltage output driver, the pixel units of even columns of the one row of pixel units are connected with an even output terminal in the group of output terminals of the common voltage output driver;

pixel units of odd columns of the other row of pixel units in any two adjacent rows of pixel units are connected with an even output terminal in the other group of output terminals of the common voltage output driver, pixel units of even columns of the other row of pixel units are connected with an odd output terminal in the other group of output terminals of the common voltage output driver.

Optionally, the display panel further comprises a timing controller, the timing controller is used for generating the polarity control signal and outputting the polarity control signal to the common voltage output driver.

Optionally, the timing controller is further used for storing a common voltage adjustment parameter and outputting the common voltage adjustment parameter to the common voltage output driver;

the common voltage output driver is further used for adjusting common voltages of pixel units having display defects based on the common voltage adjustment parameter.

The present invention provides a liquid crystal display device comprising the display panel stated above.

The present invention provides a driving method of a display panel for driving the display panel stated above, the driving method comprising:

at a Nth frame, a common voltage output driver inputting a negative common voltage to a first pixel unit, the first pixel unit being one of a plurality of pixel units defined by a plurality of gate lines and a plurality of data lines arranged crossly, N being a positive integer, when the common voltage output driver inputs the negative common voltage to the first pixel unit, the source driver inputting a data voltage greater than or equal to the negative common voltage to the first pixel unit;

at an adjacent frame of the Nth frame, the common voltage output driver inputting a positive common voltage to the first pixel unit, when the common voltage output driver inputs the positive common voltage to the first pixel unit, the source driver inputting a data voltage less than or equal to the positive common voltage to the first pixel unit.

Optionally, the driving method further comprises: the common voltage output driver receiving a polarity control signal, a logic level of the polarity control signal at the Nth frame being contrary to a logic level of the polarity control signal at an adjacent frame of the Nth frame;

wherein, at the Nth frame, the common voltage output driver inputting a negative common voltage to the first pixel unit comprises: at the Nth frame, when the polarity control signal is of a high level, the common voltage output driver inputting the negative common voltage to the first pixel unit, at the adjacent frame of the Nth frame, the common voltage output driver inputting a positive common voltage to the first pixel unit comprises: at the adjacent frame of the Nth frame, when the polarity control signal is of a low level, the common voltage output driver inputs the positive common voltage to the first pixel unit; or, wherein, at the Nth frame, the common voltage output driver inputting a negative common voltage to the first pixel unit comprises: at the Nth frame, when the polarity control signal is of a low level, the common voltage output driver inputting the negative common voltage to the first pixel unit, at the adjacent frame of the Nth frame, the common voltage output driver inputting a positive common voltage to the first pixel unit comprises:

at the adjacent frame of the Nth frame, when the polarity control signal is of a high level, the common voltage output driver inputting the positive common voltage to the first pixel unit.

Optionally, the polarity control signal comprises a first polarity control signal for controlling output of the common voltage output driver in pixel units of odd rows and pixel units of even rows, a logic level of the first polarity control signal in the pixel units of odd rows is contrary to a logic level of the first polarity control signal in the pixel units of even rows within the same frame, or, the polarity control signal comprises a second polarity control signal for controlling output of the common voltage output driver in pixel units of odd rows and a third polarity control signal for controlling output of the common voltage output driver in pixel units of even rows, a logic level of the second polarity control signal is contrary to a logic level of the third polarity control signal within the same frame, the logical levels of the second polarity control signal and the third polarity control signal are contrary within two adjacent frames;

the common voltage output driver comprises a plurality of groups of output terminals, each group of output terminals comprise an odd output terminal and an even output terminal respectively, wherein when the odd output terminal outputs a negative common voltage, the even output terminal outputs a positive common voltage, or, when the odd output terminal outputs a positive common voltage, the even output terminal outputs a negative common voltage;

in the plurality of pixel units, pixel units of odd columns in each row of pixel units are connected with an odd output terminal in a corresponding group of output terminals of the common voltage output driver respectively, pixel units of even columns in each row of pixel units are connected with an even output terminal of the corresponding group of output terminals of the common voltage output driver respectively.

Optionally, the polarity control signal is used for controlling output of the common voltage output driver in pixel units of odd rows and pixel units of even rows, the logic level of the polarity control signal is contrary within two adjacent frames, the common voltage output driver comprises a plurality of groups of output terminals, each group of output terminals comprises an odd output terminal and an even output terminal respectively, wherein, when the odd output terminal outputs a negative common voltage, the even output terminal outputs a positive common voltage, or, when the odd output terminal outputs a positive common voltage, the even output terminal outputs a negative common voltage;

in the plurality of pixel units, pixel units of odd columns in one row of pixel units of any two adjacent rows of pixel units are connected with an odd output terminal in a corresponding group of output terminals of the common voltage output driver, the pixel units of even columns of the one row of pixel units are connected with an even output terminal in the group of output terminals of the common voltage output driver;

pixel units of odd columns of the other row of pixel units in any two adjacent rows of pixel units are connected with an even output terminal in the other group of output terminals of the common voltage output driver, pixel units of even columns of the other row of pixel units are connected with an odd output terminal in the other group of output terminals of the common voltage output driver.

Optionally, the display panel further comprises a timing controller, the driving method further comprises: the timing controller generating the polarity control signal and outputting the polarity control signal to the common voltage output driver.

Optionally, the driving method further comprises:

the timing controller storing a common voltage adjustment parameter and outputting the common voltage adjustment parameter to the common voltage output driver;

the common voltage output driver adjusting common voltages of pixel units having display defects based on the common voltage adjustment parameter.

The present invention provides a display panel and a driving method thereof, as well as a liquid crystal display device, the display panel comprises a source driver and a plurality of pixel units defined by a plurality of gate lines and a plurality of data lines arranged crossly, the display panel further comprises a common voltage output driver, the common voltage output driver is used for, at a Nth frame, inputting a negative common voltage to a first pixel unit, and at an adjacent frame of the Nth frame, inputting a positive common voltage to the first pixel unit, the first pixel unit is one of the plurality of pixel units, N is a positive integer; the source driver is used for, when the common voltage output driver inputs the negative common voltage to the first pixel unit, inputting a data voltage greater than or equal to the negative common voltage to the first pixel unit, and, when the common voltage output driver inputs the positive common voltage to the first pixel unit, inputting a data voltage less than or equal to the positive common voltage to the first pixel unit.

Based on the above technical solutions, since the common voltage output driver inputs alternately varying negative common voltages and positive common voltages to a same pixel unit within two adjacent frames respectively, and when the common voltage output driver inputs a negative common voltage to a certain pixel unit, the source driver inputs a data voltage greater than or equal to the negative voltage to this pixel unit, and when the common voltage output driver inputs a positive common voltage to a certain pixel unit, the source driver inputs a data voltage less than or equal to the positive common voltage to this pixel unit, such that: on the one hand, within two adjacent frames, the polarity of the driving voltage (which is the difference value of the data voltage and the common voltage) of the same pixel unit is reversed; on the other hand, compared with the prior art, since the common voltage is a voltage varying between positive and negative, in the event that the driving voltage of the liquid crystal molecules is invariable, the variation range of the data voltage outputted by the source driver is reduced, i.e., the maximum working voltages of the source driver and the display panel are both reduced also, thereby reducing the power consumption of the display panel.

DETAILED DESCRIPTION OF THE INVENTION

Next, the display panel and the driving method thereof, as well as the liquid crystal display device provided by the embodiments of the present invention will be described in detail with reference to the drawings.

Figure 2:
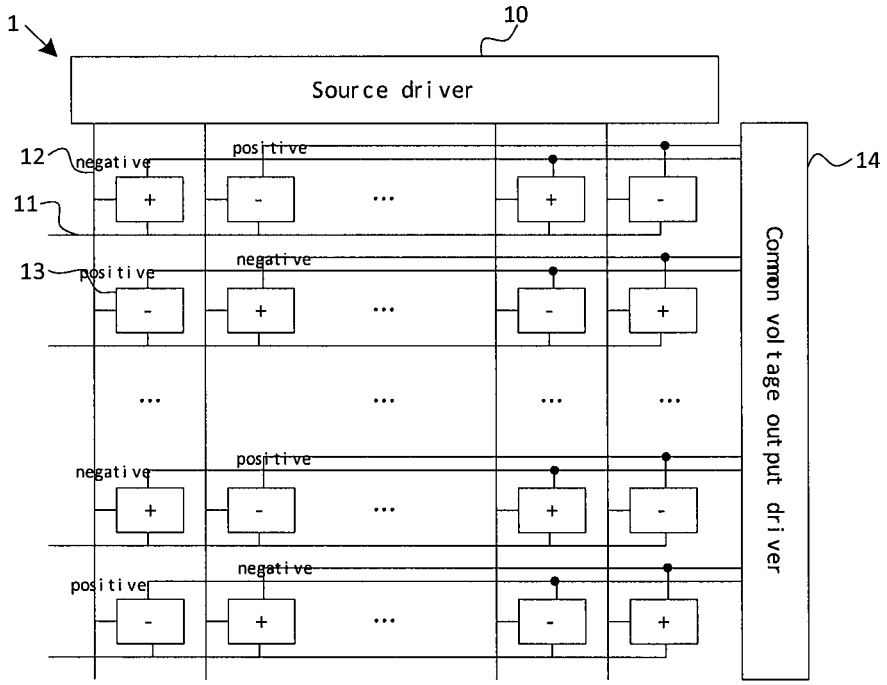
FIG. 2 is a structural schematic view I of a display panel provided by an embodiment of the present invention.

As shown in FIG. 2, an embodiment of the present invention provides a display panel 1, the display panel 1 comprises a source driver 10 and a plurality of pixel units 13 defined by a plurality of gate lines 11 and a plurality of data lines 12 arranged crossly, the display panel 1 further comprises a common voltage output driver 14.

The common voltage output driver 14 is used for, at a Nth frame, inputting a negative common voltage to a first pixel unit, and at an adjacent frame of the Nth frame, inputting a positive common voltage to the first pixel unit, the first pixel unit is one of the plurality of pixel units 13, N is a positive integer.

The source driver 10 is used for, when the common voltage output driver 14 inputs the negative common voltage to the first pixel unit, inputting a data voltage greater than or equal to the negative common voltage to the first pixel unit, and, when the common voltage output driver 14 inputs the positive common voltage to the first pixel unit, inputting a data voltage less than or equal to the positive common voltage to the first pixel unit.

Figure 3:
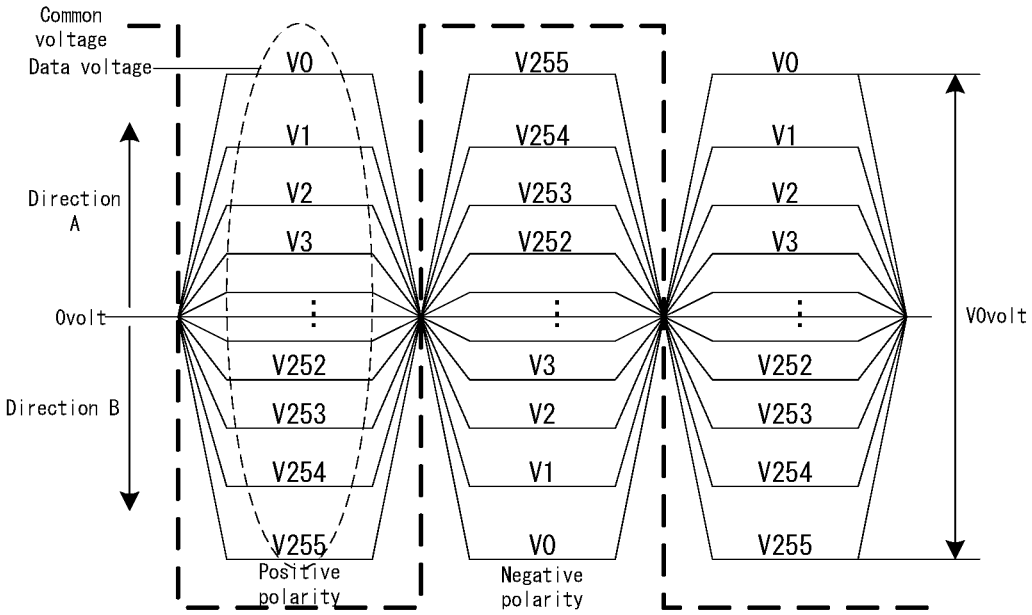
FIG. 3 is a schematic view of polarity of a driving voltage and variation range of a data voltage provided by an embodiment of the present invention.

In an embodiment of the present invention, the common voltage outputted by the common voltage output driver 14 comprises a negative common voltage and a positive common voltage. Wherein, as shown in FIG. 3, take 0V as the reference voltage, the common voltage along the direction A is a positive common voltage, the common voltage along the direction B is a negative common voltage.

Further, when the common voltage output driver 14 inputs the negative common voltage to the first pixel unit, the source driver 10 inputs a data voltage greater than or equal to the negative common voltage to the first pixel unit, so as to ensure that the polarity of the driving voltage of the first pixel unit is positive polarity; when the common voltage output driver 14 inputs the positive common voltage to the first pixel unit, the source driver 10 inputs a data voltage less than or equal to the positive common voltage to the first pixel unit, so as to ensure that the polarity of the driving voltage of the first pixel unit is negative polarity.

Exemplarily, if the common voltage of this pixel unit is −V, the data voltage inputted by the source driver 10 to this pixel unit will be greater than or equal to −V, and the polarity of the driving voltage of this pixel unit will be positive polarity; if the common voltage of this pixel unit is V, the data voltage inputted by the source driver 10 to this pixel unit will be less than or equal to V, and the polarity of the driving voltage of this pixel unit will be negative polarity, wherein V can be a positive integer.

It needs to be explained that the size of the common voltage inputted by the common voltage output driver to the pixel unit can be set based on actual use requirements, which will not be defined specifically in the present invention.

In an embodiment of the present invention, since the common voltage output driver inputs alternately varying negative common voltages and positive common voltages to a same pixel unit within two adjacent frames respectively, and when the common voltage output driver inputs a negative common voltage to a certain pixel unit, the source driver inputs a data voltage greater than or equal to the negative voltage to this pixel unit, and when the common voltage output driver inputs a positive common voltage to a certain pixel unit, the source driver inputs a data voltage less than or equal to the positive common voltage to this pixel unit, such that: on the one hand, within two adjacent frames, the polarity of the driving voltage (which is the difference value of the data voltage and the common voltage) of the same pixel unit is reversed; on the other hand, compared with the prior art, since the common voltage is a voltage varying between positive and negative, in the event that the driving voltage of the liquid crystal molecules is invariable, the variation range of the data voltage outputted by the source driver is reduced, i.e., the maximum working voltages of the source driver and the display panel are both reduced also, thereby reducing the power consumption of the display panel.

Optionally, the common voltage output driver 14 is further used for receiving a polarity control signal, a logic level of the polarity control signal at the Nth frame is contrary to a logic level of the polarity control signal at the adjacent frame of the Nth frame.

For example, the common voltage output driver 14 is used for, at the Nth frame, when the polarity control signal is of a high level, inputting the negative common voltage to the first pixel unit, and at the adjacent frame of the Nth frame, when the polarity control signal is of a low level, inputting the positive common voltage to the first pixel unit; or the common voltage output driver 14, at the Nth frame, when the polarity control signal is of a low level, inputs the negative common voltage to the first pixel nit, and at the adjacent frame of the Nth frame, when the polarity control signal is of a high level, inputs the positive common voltage to the first pixel unit.

Wherein a logic level of the polarity control signal at the Nth frame being contrary to a logic level of the polarity control signal at the adjacent frame of the Nth frame can be understood as: if the logic level of the polarity control signal is a high level at the Nth frame, the logic level of the polarity control signal will be a low level at the adjacent frame of the Nth frame; on the contrary, if the logic level of the polarity control signal is a low level at the Nth frame, the logic level of the polarity control signal will be a high level at the adjacent frame of the Nth frame.

In an embodiment of the present invention, by changing the polarity of the driving voltage of each pixel unit within two adjacent frames (i.e., the polarity of the driving voltage of each pixel unit within two adjacent frames is not the same), i.e., realizing polarity reversion of the driving voltage, it can be ensured that the rotational characteristics of the liquid crystal molecules are not destroyed.

The display panel provided by an embodiment of the present invention can be applied in driving manners such as row reversion, column reversion and point reversion based on frame reversion (the reversions in this embodiment are all polarity reversion of the driving voltage of the pixel unit), which will not defined specifically in the present invention.

The skilled person in the art can understand that compared with the driving manners of row reversion and column reversion, the driving manner of point reversion can increase the stabilized speed of the pixel unit voltage, and reduce cross talk between the pixels, hence, it can improve the display quality of the display panel so as to enable the display panel to have a high quality display effect.

Specifically, the structure of the display panel provided by an embodiment of the present invention will be explained in detail in the following through two possible implementing modes provided by an embodiment of the present invention respectively by taking the driving manner of point reversion as the example.

Optionally, in a possible implementing mode, the polarity control signal comprises a first polarity control signal for controlling output of the common voltage output driver 14 in pixel units of odd rows and pixel units of even rows, a logic level of the first polarity control signal in the pixel units of odd rows is contrary to a logic level of the first polarity control signal in the pixel units of even rows within the same frame.

Or, the polarity control signal comprises a second polarity control signal for controlling output of the common voltage output driver 14 in pixel units of odd rows and a third polarity control signal for controlling output of the common voltage output driver 14 in pixel units of even rows, a logic level of the second polarity control signal is contrary to a logic level of the third polarity control signal within the same frame, the logical levels of the second polarity control signal and the third polarity control signal are contrary within two adjacent frames.

The common voltage output driver 14 comprises a plurality of groups of output terminals, each group of output terminals comprise an odd output terminal and an even output terminal respectively, wherein when the odd output terminal outputs a negative common voltage, the even output terminal outputs a positive common voltage, or, when the odd output terminal outputs a positive common voltage, the even output terminal outputs a negative common voltage In the plurality of pixel units 13, pixel units of odd columns in each row of pixel units are connected with an odd output terminal in a corresponding group of output terminals of the common voltage output driver 14 respectively, pixel units of even columns in each row of pixel units are connected with an even output terminal of the corresponding group of output terminals of the common voltage output driver 14 respectively.

Figure 4:
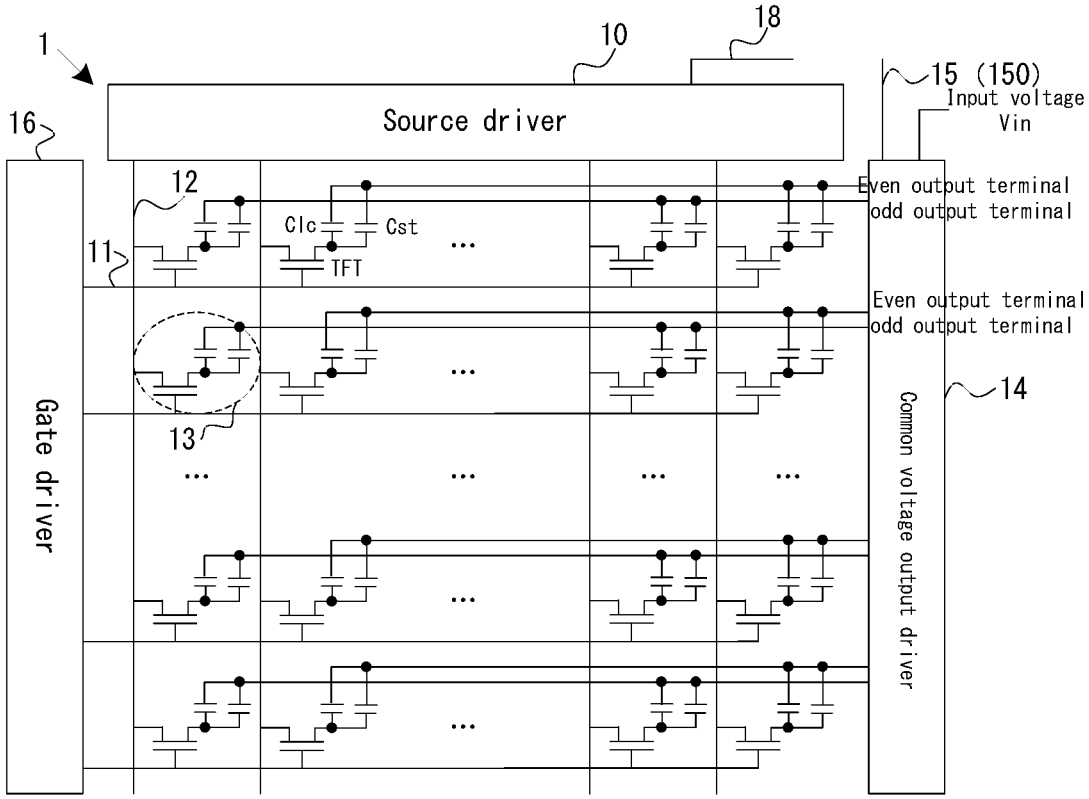
FIG. 4 is a structural schematic view II of a display panel provided by an embodiment of the present invention.

Specifically, as shown in FIG. 4, take the example that the polarity control signal 15 comprises a first polarity control signal 150, the first polarity control signal 150 controls output of the common voltage output driver 14. Each output terminal of the source driver 10 is connected with one column of pixel units, and inputs a data voltage to each column of pixel units under the control effect of a source polarity control signal 18; each group of output terminals of the common voltage output driver 14 is connected with one row of pixel units, wherein the odd output terminal in each group of output terminals of the common voltage output driver 14 is connected with pixel units of odd columns in one row of pixel units, the even output terminal in each group of output terminals of the common voltage output driver 14 is connected with pixel units of even columns in this row of pixel units. Each output terminal of a gate driver 16 is connected with one row of pixel units, for controlling ON and OFF of each row of pixel units.

Wherein the method of the source driver 10, under the control effect of the source polarity control signal 18, to input a data voltage to each column of pixel units is similar as the method of the source driver 10 in the prior art to input a data voltage to each column of pixel units, i.e., the source driver, under the control effect of the source polarity control signal 18, inputs a corresponding data voltage to a corresponding pixel unit based on the output of the common voltage output driver 14, so as to ensure that the polarity of the driving voltage of this pixel unit realizes corresponding reversion. For example, in the driving manner of row reversion, the polarities of any two adjacent rows of pixel units are contrary; in the driving manner of point reversion, the polarities of any two adjacent pixel units are contrary.

Further, in FIG. 4, each pixel unit has a thin film transistor (TFT), an equivalent capacitance Clc of the pixel unit, a pixel electrode and a common electrode line, a storage capacitance Cst is formed between the pixel electrode and the common electrode line. Wherein, one end of Clc is connected with the drain of the TFT and the pixel electrode, the other end of Clc is connected with an odd output terminal or an even output terminal (i.e., the common electrode line) of the common voltage output driver 14, the gate of the TFT is connected with one output terminal of the gate driver 15, the source of the TFT is connected with one output terminal of the source driver 10.

Figures 5, 6:
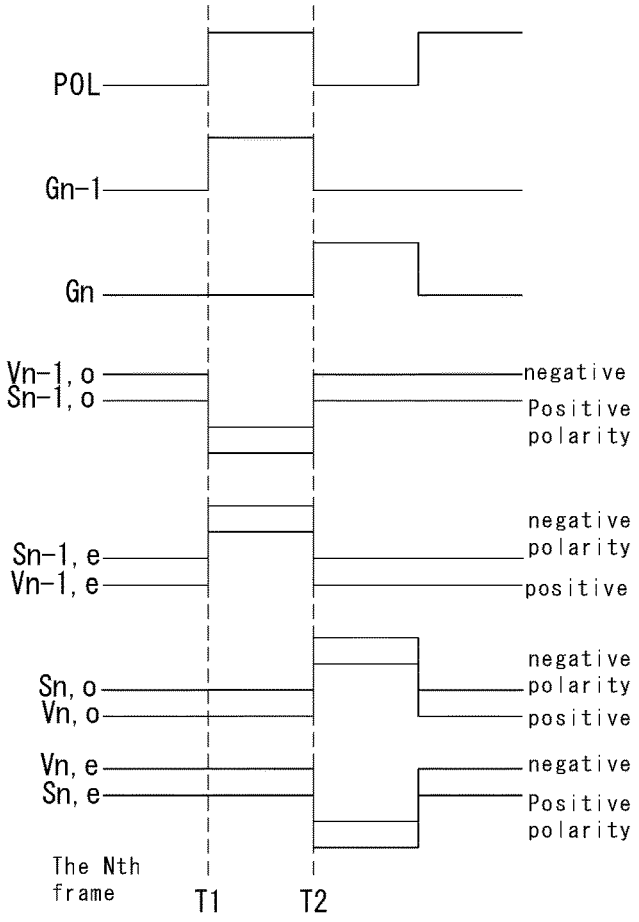
FIG. 5 is a timing diagram I of pixel units of a display panel provided by an embodiment of the present invention.
FIG. 6 is a schematic view of point reversion provided by an embodiment of the present invention.

Exemplarily, as shown in FIG. 5, this figure is a working timing diagram of a pixel unit in the circuit as shown in FIG. 4. It can be seen from combination of FIG. 4 and FIG. 5 that at the moment T1 within the Nth frame, the gate driver 16 (the gate line scan signal of the gate driver is represented as Gn−1) opens the n−1th row of pixel units, the first polarity control signal 150 (represented as POL) is of a high level, the odd output terminal (represented as Vn−1,o) in the n−1th group of output terminals of the common voltage output driver 14 outputs a negative common voltage, the even output terminal (represented as Vn−1,e) in the n−1th group of output terminals of the common voltage output driver 14 outputs a positive common voltage. A plurality of output terminals of the source driver are under control of the source polarity control signal 18, when the Vn−1,o outputs a negative common voltage, the corresponding output terminal in the plurality of output terminals of the source driver outputs a data voltage greater than or equal to the negative common voltage; when the Vn−1,e outputs a positive common voltage, the corresponding output terminal in the plurality of output terminals of the source driver outputs a data voltage less than or equal to the positive common voltage, thereby enabling the polarity of the driving voltage of the n−1th row of pixel units to be "+(representing positive polarity), − (representing negative polarity), +, −" from left to right successively (for example, the output of the source driver in pixel units of odd columns in the n−1th row of pixel units is represented as Sn−1,o, the polarity of the driving voltage in pixel units of odd columns in the n−1th row of pixel units is positive polarity; the output of the source driver in pixel units of the even columns in the n−1th row of pixel units is represented as Sn−1,e, the polarity of the driving voltage in pixel units of even columns in the n−1th row of pixel units is negative polarity).

At the moment T2 within the Nth frame, the gate driver 16 (the gate line scan signal of the gate driver is represented as Gn) opens the nth row of pixel units, the first polarity control signal 150 (represented as POL) becomes a low level, the odd output terminal (represented as Vn,o) in the nth group of output terminals of the common voltage output driver 14 outputs a positive common voltage, the even output terminal (represented as Vn,e) in the nth group of output terminals of the common voltage output driver 14 outputs a negative common voltage. A plurality of output terminals of the source driver are under control of the source polarity control signal 18, when the Vn,o outputs a positive common voltage, the corresponding output terminal in the plurality of output terminals of the source driver outputs a data voltage less than or equal to the positive common voltage; when the Vn,e outputs a negative common voltage, the corresponding output terminal in the plurality of output terminals of the source driver outputs a data voltage greater than or equal to the negative common voltage, thereby enabling the polarity of the driving voltage of the nth row of pixel units to be "−, +, −, +" from left to right successively (for example, the output of the source driver in pixel units of odd columns of the nth row of pixel units is represented as Sn,o, the polarity of the driving voltage in pixel units of odd columns in the nth row of pixel units is negative polarity; the output of the source driver in pixel units of even columns in the nth row of pixel units is represented as Sn,e, the polarity of the driving voltage in pixel units of even columns in the nth row of pixel units is positive polarity).

The above description on the circuit as shown in FIG. 4 is only exemplary description made by taking one frame (e.g., the Nth frame) as the example, at the adjacent frame of this frame, the polarities of the common voltage outputted by each output terminal of the common voltage output driver, the data voltage outputted by the source driver and the driving voltage of each pixel unit are all contrary to those in this frame. Since the implementing principle of the adjacent frame of this frame is same as the implementing principle of this frame, it will not be repeated here.

It can be seen that in the circuit as shown in FIG. 4, the output of the source driver 10 is controlled through the source polarity control signal 18, and the output of the common voltage output driver 14 is controlled through the first polarity control signal 150, such that the polarity of the driving voltage of any two adjacent pixel units can be reversed, for example, as shown in FIG. 6, thus it can be ensured that the display panel has a high quality display effect; in addition, compared with the prior art, since the common voltage is a voltage varying between positive and negative, in the event that the driving voltage of the liquid crystal molecules is invariable, the variation range of the data voltage outputted by the source driver is reduced, i.e., the maximum working voltages of the source driver and the display panel are both reduced also, thereby reducing the power consumption of the display panel.

Through the above solution, the display panel provided by an embodiment of the present invention can reduce the power consumption of the display panel while ensuring a high quality display effect.

Figure 1:
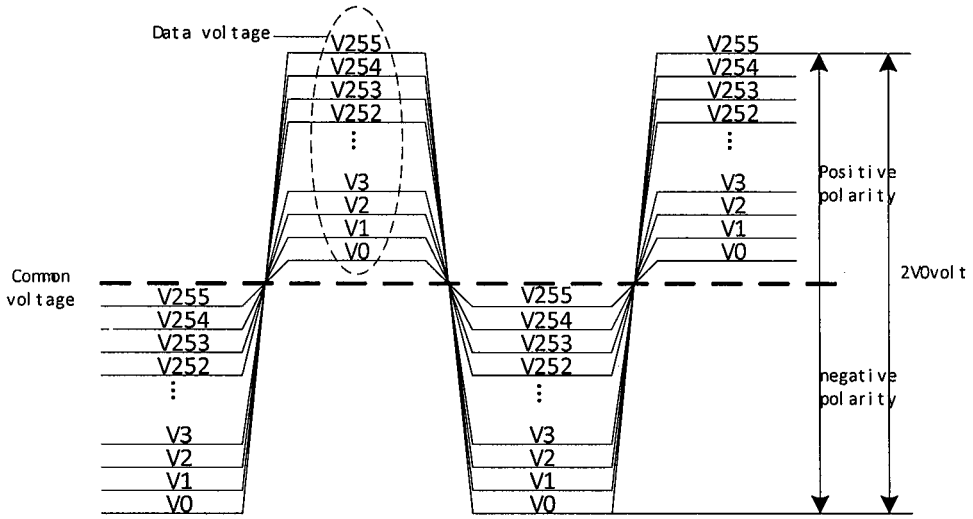
(PRIOR ART) Fig.1
FIG. 1 is a schematic view of polarity of a driving voltage and variation range of a data voltage provided by the prior art.

In order to explain further that the technical solution provided by an embodiment of the present invention, relative to the prior art, can reduce the variation range of the data voltage outputted by the source driver, i.e., enabling the maximum working voltage of the source driver and the maximum working voltage of the display panel to be both reduced, exemplary explanations will be made with reference to FIG. 1 and FIG. 3 respectively in the following. Wherein FIG. 1 is a relationship diagram of the data voltage and the common voltage provided by the prior art, i.e., a schematic view of variation range of the data voltage provided by the prior art; FIG. 3 is a relationship diagram of the data voltage and the common voltage provided by an embodiment of the present invention, i.e., a schematic view of variation range of the data voltage provided by an embodiment of the present invention.

As shown in FIG. 1, assume that the voltage value of the driving voltage required by the pixel unit is 5V, the common voltage is 0V, it can be seen that since the common voltage is a constant voltage, in order to ensure the polarity of the driving voltage of the pixel unit to be reversed, the voltage variation range of the data voltage V0 outputted by the source driver is 5V to −5V. In order to ensure the source driver to output the data voltage normally, the working voltage of the source driver needs to be 5V−(−5V)=10V, hence, the working voltage of the display panel also needs to be 10V. In addition, because the voltage value of the driving voltage required by the pixel unit is 5V, the theoretical working voltage of the display panel is also 5V, thus the actual working power consumption of the display panel is twice of the theoretical power consumption, which results in great waste of energy sources.

As shown in FIG. 3, assume that the voltage value of the driving voltage required by the pixel unit is 5V, the common voltage is −8V to 8V, it can be seen that since the common voltage is a voltage varying between positive and negative, in order to ensure the polarity of the driving voltage of the pixel unit to be reversed, the voltage variation range of the data voltage outputted by the source driver is −3V to 3V. In order to ensure the source driver to output the data voltage normally, the working voltage of the source driver can be 3V−(−3V)=6V, hence, the working voltage of the display panel is also 6V. Compared with the prior art, the actual working power consumption of the display panel provided by an embodiment of the present invention is greatly reduced, thereby saving the energy sources.

It needs to be explained that the principle of the second polarity control signal and the third polarity control signal for controlling the common voltage output driver to output the common voltage is same as the principle of the first polarity control signal for controlling the common voltage output driver to output the common voltage, reference can be made to the principle of the above first polarity control signal for controlling the common voltage output driver to output the common voltage specifically, which will not be repeated here.

Further, the difference between the process of the second polarity control signal and the third polarity control signal for controlling the common voltage output driver to output the common voltage and the process of the first polarity control signal for controlling the common voltage output driver to output the common voltage lies in: the second polarity control signal controls output of the common voltage output driver in pixel units of odd rows, the third polarity control signal controls output of the common voltage output driver in pixel units of even rows, moreover, the logic level of the second polarity control signal is contrary to the logic level of the third polarity control signal within the same frame, and the logic levels of the second polarity control signal and the third polarity control signal are contrary within each of two adjacent frames; whereas the first polarity control signal controls output of the common voltage output driver in pixel units of odd rows and pixel units of even rows, and the logic level of the first polarity control signal in pixel units of odd rows is contrary to the logic level of the first polarity control signal in pixel units of even rows within the same frame.

Figure 7:
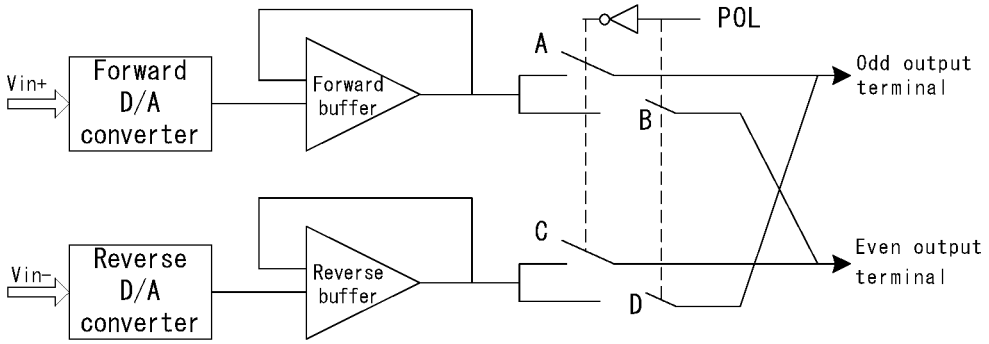
FIG. 7 is a circuit schematic view of a common voltage output driver provided by an embodiment of the present invention.

Optionally, in an embodiment of the present invention, the circuit as shown in FIG. 7 can be used for the first polarity control signal (or the second polarity control signal and the third polarity control signal) to control the odd output terminal and the even output terminal in each group of output terminals in the common voltage output driver to output different common voltages.

As shown in FIG. 7, when the first polarity control signal (represented as POL) is of a high level, point B and point D are turned on, when the point B is turned on, the even output terminal outputs a positive voltage Vin+; when the point D is turned on, the odd output terminal outputs a negative voltage Vin−. When the first polarity control signal is of a low level, point A and point C are turned on, when the point A is turned on, the odd output terminal outputs a positive voltage Vin+; when the point C is turned on, the even output terminal outputs a negative voltage Vin−.

It needs to be explained that in FIG. 7, the control of the first polarity control signal to the odd output terminal and the even output terminal of the common voltage output driver can be realized through a NOT gate exemplarily, certainly, such a control effect of the first polarity control signal can also be realized through other circuit, which will not be defined in the present invention specifically. Any circuit that can realize such a control effect of the first polarity control signal to the odd output terminal and the even output terminal of the common voltage output driver should fall within the protection scope of the present invention.

The above descriptions on that the common voltage inputted by the common voltage output driver to each pixel unit in the circuit as shown in FIG. 4 is a positive common voltage or a negative common voltage are all exemplary explanations made on the basis of the circuit as shown in FIG. 7, if the control effect of the first polarity control signal in FIG. 7 is realized by other circuits, the common voltage inputted by the common voltage output driver to each pixel unit in the circuit as shown in FIG. 4 will also vary accordingly, which will not be defined specifically in the present invention.

Optionally, in another possible implementing mode, the polarity control signal is used for controlling output of the common voltage output driver 14 in pixel unit of odd rows and pixel unit of even rows, the logic level of the polarity control signal is contrary within two adjacent frames, the common voltage output driver 14 comprises a plurality of groups of output terminals, each group of output terminals comprises an odd output terminal and an even output terminal respectively, wherein, when the odd output terminal outputs a negative common voltage, the even output terminal outputs a positive common voltage, or, when the odd output terminal outputs a positive common voltage, the even output terminal outputs a negative common voltage.

In the plurality of pixel units 13, pixel units of odd columns in one row of pixel units of any two adjacent rows of pixel units are connected with an odd output terminal in a corresponding group of output terminals of the common voltage output driver 14, the pixel units of even columns of the one row of pixel units are connected with an even output terminal in the group of output terminals of the common voltage output driver 14.

Pixel units of odd columns of the other row of pixel units in any two adjacent rows of pixel units are connected with an even output terminal in the other group of output terminals of the common voltage output driver 14, pixel units of even columns of the other row of pixel units are connected with an odd output terminal in the other group of output terminals of the common voltage output driver 14.

Wherein the logic level of the polarity control signal being contrary within two adjacent frames can be understood as: if the logic level of the polarity control signal is a high level at a certain frame, the logic level of the polarity control signal will be a low level at the adjacent frame of the frame; on the contrary, if the logic level of the polarity control signal is a low level at a certain frame, the logic level of the polarity control signal will be a high level at the adjacent frame of the frame.

Figure 8:
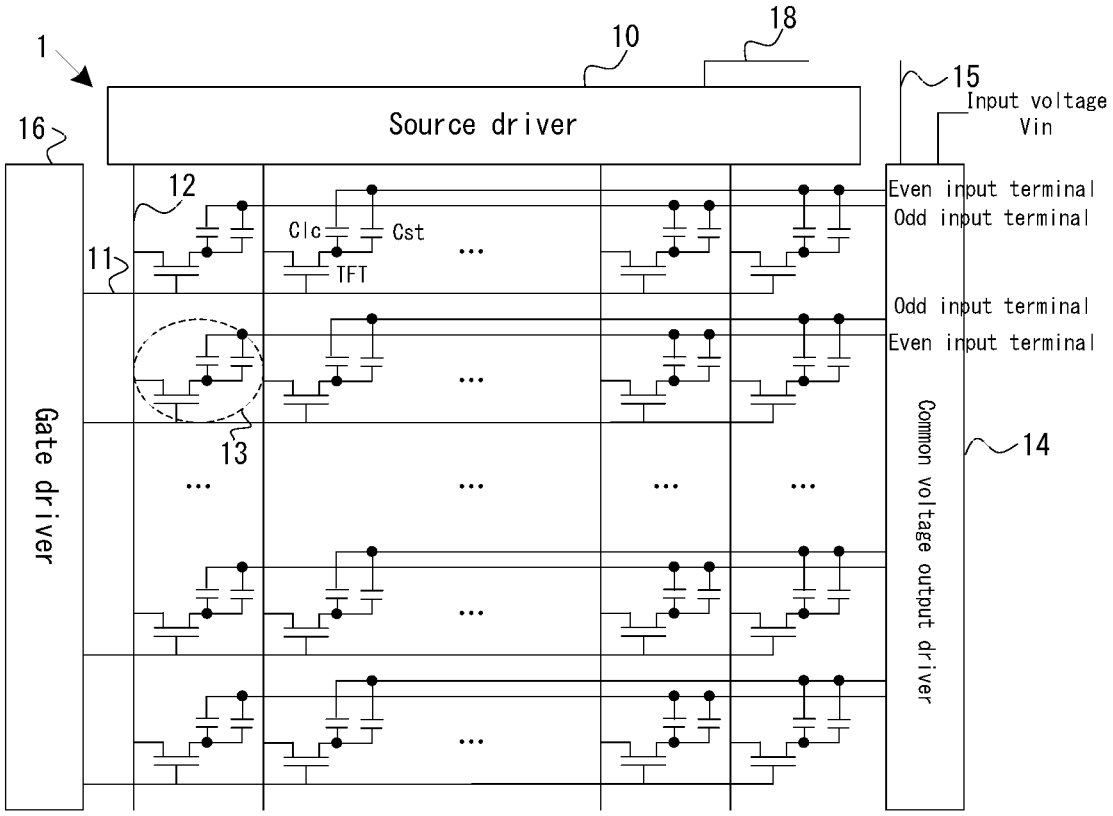
FIG. 8 is a structural schematic view III of a display panel provided by an embodiment of the present invention.

Specifically, as shown in FIG. 8, the polarity control signal 15 controls output of the common voltage output driver 14. Each output terminal of the source driver 10 is connected with one column of pixel units, and inputs a data voltage to each column of pixel units under the control effect of the source polarity control signal 18; each group of output terminals of the common voltage output driver 14 is connected with one row of pixel units, wherein in one row of pixel units of any two adjacent rows of pixel units, the odd output terminal in each group of output terminals of the common voltage output driver 14 is connected with pixel units of odd columns in this row of pixel units, the even output terminal in each group of output terminals of the common voltage output driver 14 is connected with pixel units of even columns in this row of pixel units; in the other row of pixel units in any two adjacent rows of pixel units, the odd output terminal in each group of output terminals of the common voltage output driver 14 is connected with pixel units of even columns in this row of pixel units, the even output terminal in each group of output terminals of the common voltage output driver 14 is connected with pixel units of odd columns in this row of pixel units. Each output terminal of the gate driver 16 is connected with one row of pixel units, for controlling ON and OFF of each row of pixel units.

Further, in the circuit as shown in FIG. 8, the structure of each pixel unit is same as the structure of the pixel unit in the embodiment as shown in FIG. 4, reference can be made to the structure of the pixel unit in the embodiment as shown in FIG. 4 specifically, which will not be repeated here.

Wherein, the method of the source driver 10, under the control effect of the source polarity control signal 18, for inputting a data voltage to each column of pixel units is similar as the method of the source driver 10 for inputting a data voltage to each column of pixel units in the prior art, reference can be made to the above related description on that the source driver 10 inputs a data voltage to each column of pixel units under the control effect of the source polarity control signal 18 in the embodiment as shown in FIG. 4 specifically, which will not be repeated here.

Figure 9:
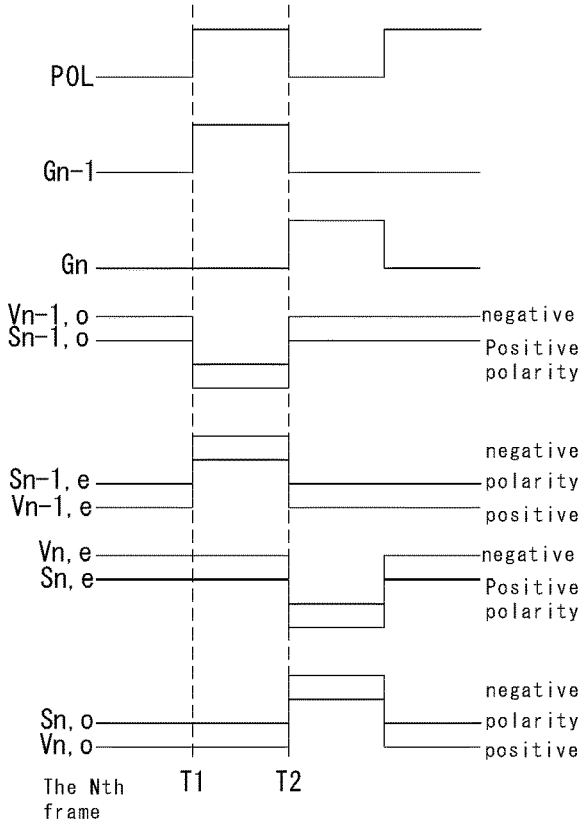
FIG. 9 is a timing diagram II of pixel units of a display panel provided by an embodiment of the present invention.

Exemplarily, as shown in FIG. 9, this figure is a working timing diagram of a pixel unit in the circuit as shown in FIG. 8 at the Nth frame. It can be seen from combination of FIG. 8 and FIG. 9 that at the moment T1 within the Nth frame, the gate driver 16 (the gate line scan signal of the gate driver is represented as Gn−1) opens the n−1th row of pixel units, the first polarity control signal 150 (represented as POL) is of a high level, the odd output terminal (represented as Vn−1,o) in the n−1th group of output terminals of the common voltage output driver 14 outputs a negative common voltage, the even output terminal (represented as Vn−1,e) in the n−1th group of output terminals of the common voltage output driver 14 outputs a positive common voltage. A plurality of output terminals of the source driver are under control of the source polarity control signal 18, when the Vn−1,o outputs a negative common voltage, the corresponding output terminal in the plurality of output terminals of the source driver outputs a data voltage greater than or equal to the negative common voltage; when the Vn−1,e outputs a positive common voltage, the corresponding output terminal in the plurality of output terminals of the source driver outputs a data voltage less than or equal to the positive common voltage, thereby enabling the polarity of the driving voltage of the n−1th row of pixel units to be "+ (representing positive polarity), − (representing negative polarity), +, −" from left to right successively (for example, the output of the source driver in pixel units of odd columns in the n−1th row of pixel units is represented as Sn−1,o, the polarity of the driving voltage in pixel units of odd columns in the n−1th row of pixel units is positive polarity; the output of the source driver in pixel units of even columns in the n−1th row of pixel units is represented as Sn−1,e, the polarity of the driving voltage in pixel units of even columns in the n−1th row of pixel units is negative polarity).

At the moment T2 within the Nth frame, the gate driver 16 (the gate line scan signal of the gate driver is represented as Gn) opens the nth row of pixel units, the first polarity control signal 150 becomes a low level. The odd output terminal (represented as Vn,o) in the nth group of output terminals of the common voltage output driver 14 outputs a positive common voltage, the even output terminal (represented as Vn,e) in the nth group of output terminals of the common voltage output driver 14 outputs a negative common voltage. A plurality of output terminals of the source driver are under control of the source polarity control signal 18, when the Vn,o outputs a positive common voltage, the corresponding output terminal in the plurality of output terminals of the source driver outputs a data voltage less than or equal to the positive common voltage; when the Vn,e outputs a negative common voltage, the corresponding output terminal in the plurality of output terminals of the source driver outputs a data voltage greater than or equal to the negative common voltage, thereby enabling the polarity of the driving voltage of the nth row of pixel units to be "−, +, −, +" from left to right successively (for example, the output of the source driver in pixel units of odd columns in the nth row of pixel units is represented as Sn,o, the polarity of the driving voltage in pixel units of odd columns in the nth row of pixel units is negative polarity; the output of the source driver in pixel units of even columns in the nth row of pixel units is represented as Sn,e, the polarity of the driving voltage in pixel units of even columns in the nth row of pixel units is positive polarity).

The above description on the circuit as shown in FIG. 8 is only exemplary description made by taking one frame (e.g., the Nth frame) as the example, at the adjacent frame of this frame, the polarities of the common voltage outputted by each output terminal of the common voltage output driver, the data voltage outputted by the source driver and the driving voltage of each pixel unit are all contrary to those in this frame. Since the implementing principle of the adjacent frame of this frame is same as the implementing principle of this frame, it will not be repeated here.

It can be seen that in the circuit as shown in FIG. 8, the output of the source driver 10 is controlled through the source polarity control signal 18, and the output of the common voltage output driver 14 is controlled through the polarity control signal 15, such that the polarity of the driving voltage of any two adjacent pixel units can be reversed, for example, as shown in FIG. 6, thus it can be ensured that the display panel has a high quality display effect; in addition, compared with the prior art, since the common voltage is a voltage varying between positive and negative, in the event that the driving voltage of the liquid crystal molecules is invariable, the variation range of the data voltage outputted by the source driver is reduced, i.e., the maximum working voltages of the source driver and the display panel are both reduced also, thereby reducing the power consumption of the display panel.

Through the above solution, the display panel provided by an embodiment of the present invention can reduce the power consumption of the display panel while ensuring a high quality display effect.

The technical solution provided by an embodiment of the present invention, relative to the prior art, can reduce the variation range of the data voltage outputted by the source driver, i.e., enabling the maximum working voltage of the source driver and the maximum working voltage of the display panel to be both reduced. Specific description can make reference to the related descriptions on FIG. 1 and FIG. 3 in the above embodiments, which will not be repeated here.

Optionally, in an embodiment of the present invention, as stated above, a column of pixel units can be connected with a same data line (i.e., an output terminal of the source driver). Certainly, in a column of pixel units, the pixel units of odd rows can be connected with a same data line, pixel units of even rows can be connected with another data line adjacent to this data line, i.e., a column of pixel units are crossly connected with two adjacent data lines from up to down successively; when a column of pixel units are crossly connected with two adjacent data lines from up to down successively, in the display panel provided by an embodiment of the present invention, the variation of the logic level of the polarity control signal and the connecting manner of the pixel units and the common voltage output driver are all same as the related contents in the embodiment as shown in FIG. 8, which will not be repeated here.

It can be understood that no matter what kind of connecting manner is adopted for the pixel units and the common voltage output driver and how the direction of the polarity control signal is controlled in an embodiment of the present invention, as long as the common voltage output driver can input a common voltage varying between positive and negative to the pixel units, and when the common voltage output driver inputs a positive common voltage to a pixel unit, the source driver input a data voltage less than or equal to the positive common voltage to the pixel unit, and when the common voltage output driver inputs a negative common voltage to the pixel unit, the source driver inputs a data voltage greater than or equal to the negative common voltage to the pixel unit, these implementing modes are all covered within the protection scope of the present invention.

Optionally, in an embodiment of the present invention, the polarity control signal controlling the odd output terminal and the even output terminal in each group of output terminals in the common voltage output driver to output different common voltage can be realized by using the circuit as shown in FIG. 7.

The related description on the circuit as shown in FIG. 7 can make reference to the description of the circuit as shown in FIG. 7 in the above embodiments, which will not be repeated here.

The above descriptions on that the common voltage inputted by the common voltage output driver to each pixel unit in the circuit as shown in FIG. 8 is a positive common voltage or a negative common voltage are all exemplary explanations made on the basis of the circuit as shown in FIG. 7, if the control effect of the first polarity control signal in FIG. 7 is realized by other circuits, the common voltage inputted by the common voltage output driver to each pixel unit in the circuit as shown in FIG. 8 will also vary accordingly, which will not be defined specifically in the present invention.

Figure 10:
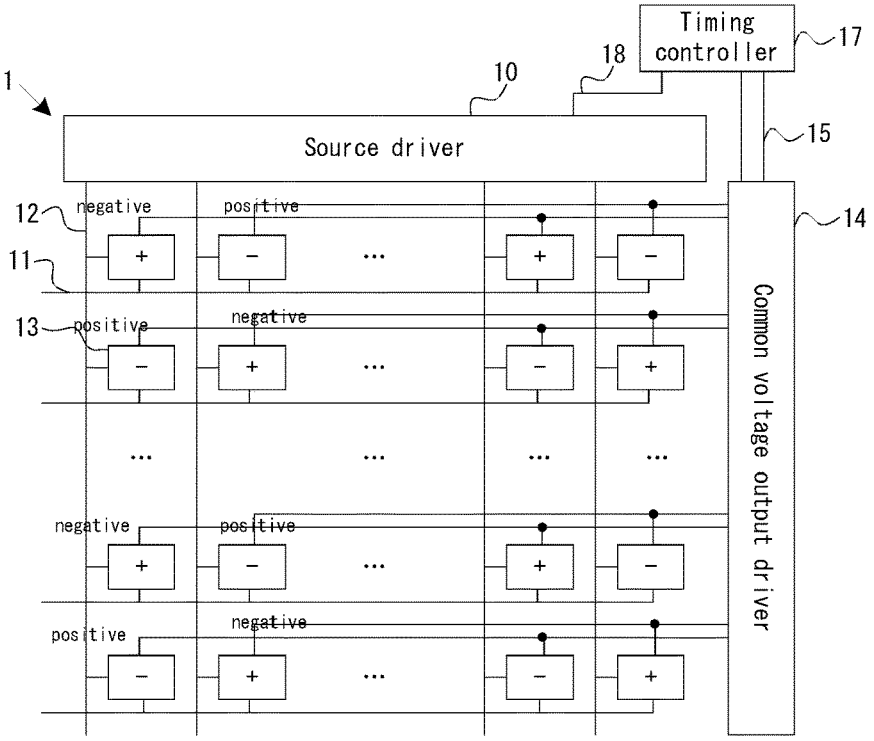
FIG. 10 is a structural schematic view IV of a display panel provided by an embodiment of the present invention.

Optionally, combined with FIG. 2, as shown in FIG. 10, the display panel 1 provided by an embodiment of the present invention may further comprise a timing controller 17.

The timing controller 17 is used for generating a polarity control signal 15 and outputting the polarity control signal 15 to the common voltage output driver.

Optionally, the timing controller 17 is further used for generating a source polarity control signal 18 and outputting the source polarity control signal 18 to the source driver 10.

Optionally, the timing controller 17 is further used for storing a common voltage adjustment parameter and outputting the common voltage adjustment parameter to the common voltage output driver 14, the common voltage adjustment parameter is used for adjusting common voltages of pixel units having display defects.

The common voltage output driver 14 is further used for adjusting common voltages of pixel units having display defects based on the common voltage adjustment parameter.

In an embodiment of the present invention, when a certain pixel unit has display defects, the common voltage adjustment parameter stored in the timing controller can be used for adjusting the common voltage of the pixel unit having display defects. For example, the timing controller can output the common voltage adjustment parameter to the common voltage output driver to adjust the common voltage of the pixel unit having display defects by the common voltage output driver based on the common voltage adjustment parameter. The common voltages of some pixel units can be adjusted through the common voltage adjustment parameter, thereby realizing local adjustment of the common voltage, so as to improve the problem of nonuniform image display of the liquid crystal display panel cased by influence of parasitic capacitance on the liquid crystal display panel to the common voltage, i.e., by adjusting the common voltage of the pixel unit having display defects, the image display of the pixel unit having display defects can be improved.

The embodiment of the present invention provides a display panel, the display panel comprises a source driver and a plurality of pixel units defined by a plurality of gate lines and a plurality of data lines arranged crossly, the display panel further comprises a common voltage output driver, the common voltage output driver is used for, at a Nth frame, inputting a negative common voltage to a first pixel unit, and at an adjacent frame of the Nth frame, inputting a positive common voltage to the first pixel unit, the first pixel unit is one of the plurality of pixel units, N is a positive integer; the source driver is used for, when the common voltage output driver inputs the negative common voltage to the first pixel unit, inputting a data voltage greater than or equal to the negative common voltage to the first pixel unit, and, when the common voltage output driver inputs the positive common voltage to the first pixel unit, inputting a data voltage less than or equal to the positive common voltage to the first pixel unit.

Based on the above technical solutions, since the common voltage output driver inputs alternately varying negative common voltages and positive common voltages to a same pixel unit within two adjacent frames respectively, and when the common voltage output driver inputs a negative common voltage to a certain pixel unit, the source driver inputs a data voltage greater than or equal to the negative voltage to this pixel unit, and when the common voltage output driver inputs a positive common voltage to a certain pixel unit, the source driver inputs a data voltage less than or equal to the positive common voltage to this pixel unit, such that: on the one hand, within two adjacent frames, the polarity of the driving voltage (which is the difference value of the data voltage and the common voltage) of the same pixel unit is reversed; on the other hand, compared with the prior art, since the common voltage is a voltage varying between positive and negative, in the event that the driving voltage of the liquid crystal molecules is invariable, the variation range of the data voltage outputted by the source driver is reduced, i.e., the maximum working voltages of the source driver and the display panel are both reduced also, thereby reducing the power consumption of the display panel.

An embodiment of the present invention provides a liquid crystal display device, the liquid crystal display device can comprise the display panel 1 stated in the above embodiment. The related description on the display panel 1 can make reference to the description on the display panel 1 in any one of the above FIG. 2 to FIG. 10, which will not be repeated here.

Figure 11:
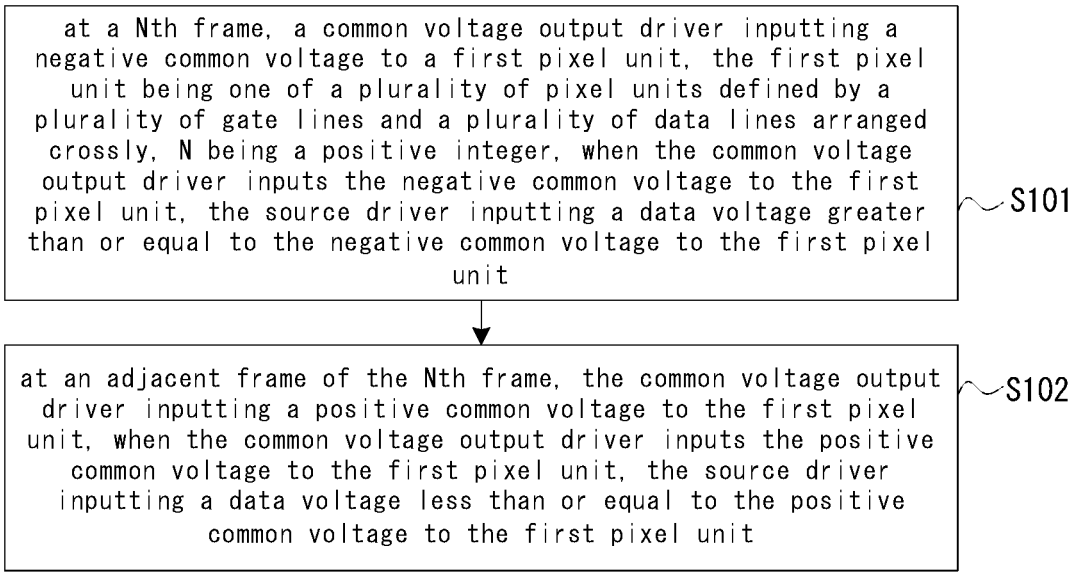
FIG. 11 is a flow chart of a driving method of a display panel provided by an embodiment of the present invention.

As shown in FIG. 11, an embodiment of the present invention further provides a driving method of a display panel, the driving method can be used for driving the display panel as stated in any of the above FIG. 2 to FIG. 10, the method may comprise:

S101, at a Nth frame, a common voltage output driver inputting a negative common voltage to a first pixel unit, the first pixel unit being one of a plurality of pixel units defined by a plurality of gate lines and a plurality of data lines arranged crossly, N being a positive integer, when the common voltage output driver inputs the negative common voltage to the first pixel unit, the source driver inputting a data voltage greater than or equal to the negative common voltage to the first pixel unit.

S102, at an adjacent frame of the Nth frame, the common voltage output driver inputting a positive common voltage to the first pixel unit, when the common voltage output driver inputs the positive common voltage to the first pixel unit, the source driver inputting a data voltage less than or equal to the positive common voltage to the first pixel unit.

The driving method of a display panel provided by an embodiment of the present invention can be applied in driving manners such as row reversion, column reversion and point reversion based on frame reversion (the reversions in this embodiment are all polarity reversion of the driving voltage of the pixel unit), which will not defined specifically in the present invention.

The skilled person in the art can understand that compared with the driving manners of row reversion and column reversion, the driving manner of point reversion can increase the steady speed of the pixel unit voltage, and reduce cross talk between the pixels, hence, it can improve the display quality of the display panel so as to enable the display panel to have a high quality display effect.

Optionally, before the above S101, the driving method of a display panel provided by an embodiment of the present invention may further comprise:

S103, the common voltage output driver receiving a polarity control signal, a logic level of the polarity control signal at the Nth frame being contrary to a logic level of the polarity control signal at an adjacent frame of the Nth frame.

Wherein, a logic level of the polarity control signal at the Nth frame being contrary to a logic level of the polarity control signal at the adjacent frame of the Nth frame can be understood as: if the logic level of the polarity control signal is a high level at the Nth frame, the logic level of the polarity control signal will be a low level at the adjacent frame of the Nth frame; on the contrary, if the logic level of the polarity control signal is a low level at the Nth frame, the logic level of the polarity control signal will be a high level at the adjacent frame of the Nth frame.

Further, the above S101 and S102 specifically may comprise:

S101*a*, at the Nth frame, when the polarity control signal is of a high level, the common voltage output driver inputting the negative common voltage to the first pixel unit.

S102*a*, at the adjacent frame of the Nth frame, when the polarity control signal is of a low level, the common voltage output driver inputting the positive common voltage to the first pixel unit.

Or, the above S101 and S102 specifically may comprise:

S101*a*, at the Nth frame, when the polarity control signal is of a low level, the common voltage output driver inputting the negative common voltage to the first pixel unit.

S102*a*, at the adjacent frame of the Nth frame, when the polarity control signal is of a high level, the common voltage output driver inputting the positive common voltage to the first pixel unit.

Specifically, the embodiment of the present invention can drive the display panel in the driving manner of point reversion, for example, refer to the above exemplary explanations made by taking the display panel as shown in FIG. 4 and FIG. 8 as the example. The related descriptions of FIG. 4 and FIG. 8 may refer to the related descriptions in the above embodiment, which will not be repeated here.

Optionally, one possible implementing mode of the driving method of a display panel provided by an embodiment of the present invention is that the polarity control signal comprises a first polarity control signal for controlling output of the common voltage output driver in pixel units of odd rows and pixel units of even rows, a logic level of the first polarity control signal in the pixel units of odd rows is contrary to a logic level of the first polarity control signal in the pixel units of even rows within the same frame.

Or, the polarity control signal comprises a second polarity control signal for controlling output of the common voltage output driver in pixel units of odd rows and a third polarity control signal for controlling output of the common voltage output driver in pixel units of even rows, a logic level of the second polarity control signal is contrary to a logic level of the third polarity control signal within the same frame, the logic levels of the second polarity control signal and the third polarity control signal are contrary within two adjacent frames.

The common voltage output driver comprises a plurality of groups of output terminals, each group of output terminals comprise an odd output terminal and an even output terminal respectively, wherein when the odd output terminal outputs a negative common voltage, the even output terminal outputs a positive common voltage, or, when the odd output terminal outputs a positive common voltage, the even output terminal outputs a negative common voltage.

In the plurality of pixel units, pixel units of odd columns in each row of pixel units are connected with an odd output terminal in a corresponding group of output terminals of the common voltage output driver respectively, pixel units of even columns in each row of pixel units are connected with an even output terminal of the corresponding group of output terminals of the common voltage output driver respectively.

Specifically, in the one possible implementing mode stated above, the related descriptions on the structure of the pixel unit and the connecting manners of the pixel unit and the common voltage output driver can make reference to the above descriptions on the structure of the pixel unit and the connecting manners of the pixel unit and the common voltage output driver in the embodiment as shown in FIG. 4, which will not be repeated here.

Optionally, the other possible implementing mode of the driving method of a display panel provided by an embodiment of the present invention is that the polarity control signal is used for controlling output of the common voltage output driver in pixel units of odd rows and pixel units of even rows, the logic level of the polarity control signal is contrary within two adjacent frames.

The common voltage output driver comprises a plurality of groups of output terminals, each group of output terminals comprises an odd output terminal and an even output terminal respectively, wherein, when the odd output terminal outputs a negative common voltage, the even output terminal outputs a positive common voltage, or, when the odd output terminal outputs a positive common voltage, the even output terminal outputs a negative common voltage;

In the plurality of pixel units, pixel units of odd columns in one row of pixel units of any two adjacent rows of pixel units are connected with an odd output terminal in a group of output terminals of the common voltage output driver, the pixel units of even columns of the one row of pixel units are connected with an even output terminal in the group of output terminals of the common voltage output driver.

Pixel units of odd columns of the other row of pixel units in any two adjacent rows of pixel units are connected with an even output terminal in another group of output terminals of the common voltage output driver, pixel units of even columns of the other row of pixel units are connected with an odd output terminal in the other group of output terminals of the common voltage output driver Specifically, in the other possible implementing mode stated above, the related descriptions on the structure of the pixel unit and the connecting manners of the pixel unit and the common voltage output driver can make reference to the above descriptions on the structure of the pixel unit and the connecting manners of the pixel unit and the common voltage output driver in the embodiment as shown in FIG. 8, which will not be repeated here.

Optionally, the above display panel may further comprise a timing controller, before the above S101, the driving method of a display panel provided by an embodiment of the present invention may further comprise:

S103, the timing controller generating the polarity control signal and outputting the polarity control signal to the common voltage output driver.

Optionally, the driving method of a display panel provided by an embodiment of the present invention may further comprise:

S104, the timing controller outputting the common voltage adjustment parameter stored by it to the common voltage output driver.

S105, the common voltage output driver adjusting common voltages of pixel units having display defects based on the common voltage adjustment parameter.

In an embodiment of the present invention, when a certain pixel unit has display defects, e.g., nonuniform image display of the liquid crystal display panel caused by the influence of the parasitic capacitance on the liquid crystal display panel to the common voltage, the timing controller can output the voltage adjustment parameter stored by it to the common voltage output driver to adjust the common voltage of the pixel unit having display defects by the common voltage output driver based on the common voltage adjustment parameter, and provide the adjusted common voltage to the corresponding pixel unit. Thus, the common voltages of some pixel units can be adjusted through the common voltage adjustment parameter, thereby realizing local adjustment of the common voltage, so as to improve the problem of nonuniform image display of the liquid crystal display panel cased by influence of parasitic capacitance on the liquid crystal display panel to the common voltage, i.e., by adjusting the common voltage of the pixel unit having display defects, the image display of the pixel unit having display defects can be improved.

In an embodiment of the present invention, not only S101-S102 but also S104-S105 can be performed. For example, for part of the pixel units, e.g. pixel units having display defects, S104-S105 can be performed firstly, then S101-S102 are performed; for other pixel units, e.g., pixel units without display defects, S101-S102 can be performed only.

The embodiment of the present invention provides a driving method of a display panel, at a Nth frame, the common voltage output driver inputs a negative common voltage to a first pixel unit, the first pixel unit is one of the plurality of pixel units defined by a plurality of gate lines and a plurality of data lines arranged crossly, N is a positive integer, when the common voltage output driver inputs the negative common voltage to the first pixel unit, the source driver inputs a data voltage greater than or equal to the negative common voltage to the first pixel unit; at an adjacent frame of the Nth frame, the common voltage output driver inputs a positive common voltage to the first pixel unit, when the common voltage output driver inputs the positive common voltage to the first pixel unit, the source driver inputs a data voltage less than or equal to the positive common voltage to the first pixel unit.

Based on the above technical solutions, since the common voltage output driver inputs alternately varying negative common voltages and positive common voltages to a same pixel unit within two adjacent frames respectively, and when the common voltage output driver inputs a negative common voltage to a certain pixel unit, the source driver inputs a data voltage greater than or equal to the negative voltage to this pixel unit, and when the common voltage output driver inputs a positive common voltage to a certain pixel unit, the source driver inputs a data voltage less than or equal to the positive common voltage to this pixel unit, such that: on the one hand, within two adjacent frames, the polarity of the driving voltage (which is the difference value of the data voltage and the common voltage) of the same pixel unit is reversed; on the other hand, compared with the prior art, since the common voltage is a voltage varying between positive and negative, in the event that the driving voltage of the liquid crystal molecules is invariable, the variation range of the data voltage outputted by the source driver is reduced, i.e., the maximum working voltages of the source driver and the display panel are both reduced also, thereby reducing the power consumption of the display panel.

The skilled person in the art can understand clearly that in order to describe the present invention conveniently and concisely, illustrations are only made through the above descriptions, in actual applications, it can also be implemented in other similar manners.

It should be understood that in several embodiments provided by the present invention, the disclosed circuit modules can also be implemented in other manners. That is, the circuit modules described above are only schematic.

Moreover, the unit explained as a separate component can be either physically separated or not physically separated, the component shown as a unit can be either a physical unit or not a physical unit. That is, the component can be located at a place, or can be districted on a plurality of units. Part or all of the units thereof can be selected to carry out the embodiments of the present invention based on actual requirements.

In addition, the functional units in the respective embodiments of the present invention can be integrated in a processing unit, or, the respective units can be separate physical existence, or, two or more units can be integrated in one unit. The above integrated units can be implemented in the form of hardware or in the form of software functional units.

What are stated above are only specific implementing modes of the present invention, however, the protection scope of the present invention is not limited to this. Any modifications or replacements that can be easily conceived by the skilled person familiar with the present technical field within the technical scope disclosed by the present invention should be encompassed within the protection scope of the present invention. Therefore, the protection scope of the present invention should be subject to the protection scopes of the claims attached.

The invention claimed is:

1. A display panel comprising:

a source driver;

a plurality of pixel units defined by a plurality of gate lines and a plurality of data lines arranged crossly, the pixel units being arranged in rows and columns;

a timing controller operable to generate a polarity control signal and to store a common voltage adjustment parameter; and a common voltage output driver operable to output common voltages based on the polarity control signal, and to adjust the common voltages for defective ones of the plurality of pixel units having display defects based on the common voltage adjustment parameter, wherein the common voltage output driver is used for, at a Nth frame, inputting a negative common voltage to a first pixel unit, and at an adjacent frame of the Nth frame, inputting a positive common voltage to the first pixel unit, the first pixel unit is one of the plurality of pixel units, N is a positive integer;

wherein the source driver is used for, when the common voltage output driver inputs the negative common voltage to the first pixel unit, inputting a data voltage greater than or equal to the negative common voltage to the first pixel unit, and, when the common voltage output driver inputs the positive common voltage to the first pixel unit, inputting a data voltage less than or equal to the positive common voltage to the first pixel unit; and wherein the common voltage output driver comprises a plurality of pairs of output terminals, each pair of output terminals comprising an odd output terminal connected to pixel units of odd columns in a respective one of the rows of pixel units without being connected to the pixel units of another one of the rows of pixel units, and an even output terminal connected to pixel units of even columns in the respective row of pixel units without being connected to the pixel units of another one of the rows of pixel units, each pair of output terminals being independent from another.

2. The display panel according to claim 1, wherein a logic level of the polarity control signal at the Nth frame is contrary to a logic level of the polarity control signal at the adjacent frame of the Nth frame, and wherein the common voltage output driver is configured to:

input the negative common voltage to the first pixel unit at the Nth frame when the polarity control signal is of a high level, and input the positive common voltage to the first pixel unit at the adjacent frame of the Nth frame when the polarity control signal is of a low level; or input the negative common voltage to the first pixel unit at the Nth frame when the polarity control signal is of a low level, and input the positive common voltage to the first pixel unit at the adjacent frame of the Nth frame when the polarity control signal is of a high level.

3. The display panel according to claim 2, wherein, the polarity control signal comprises a first polarity control signal for controlling output of the common voltage output driver in pixel units of odd rows and pixel units of even rows, a logic level of the first polarity control signal in the pixel units of odd rows being contrary to a logic level of the first polarity control signal in the pixel units of even rows within the same frame, or the polarity control signal comprises a second polarity control signal for controlling output of the common voltage output driver in pixel units of odd rows and a third polarity control signal for controlling output of the common voltage output driver in pixel units of even rows, a logic level of the second polarity control signal being contrary to a logic level of the third polarity control signal within the same frame, the logic levels of the second polarity control signal and the third polarity control signal being contrary within two adjacent frames.

4. The display panel according to claim 2, wherein the polarity control signal is used for controlling output of the common voltage output driver in pixel units of odd rows and pixel units of even rows, the logic level of the polarity control signal being contrary within two adjacent frames.

5. A liquid crystal display device comprising a display panel as claimed in claim 1.

6. The liquid crystal display device according to claim 5, wherein a logic level of the polarity control signal at the Nth frame is contrary to a logic level of the polarity control signal at the adjacent frame of the Nth frame, and wherein the common voltage output driver is configured to:

input the negative common voltage to the first pixel unit at the Nth frame when the polarity control signal is of a high level, and input the positive common voltage to the first pixel unit at the adjacent frame of the Nth frame when the polarity control signal is of a low level; or input the negative common voltage to the first pixel unit at the Nth frame when the polarity control signal is of a low level, and input the positive common voltage to the first pixel unit at the adjacent frame of the Nth frame when the polarity control signal is of a high level.

7. The liquid crystal display device according to claim 6, wherein, the polarity control signal comprises a first polarity control signal for controlling output of the common voltage output driver in pixel units of odd rows and pixel units of even rows, a logic level of the first polarity control signal in the pixel units of odd rows being contrary to a logic level of the first polarity control signal in the pixel units of even rows within the same frame, or the polarity control signal comprises a second polarity control signal for controlling output of the common voltage output driver in pixel units of odd rows and a third polarity control signal for controlling output of the common voltage output driver in pixel units of even rows, a logic level of the second polarity control signal being contrary to a logic level of the third polarity control signal within the same frame, the logic levels of the second polarity control signal and the third polarity control signal being contrary within two adjacent frames.

8. The liquid crystal display device according to claim 6, wherein the polarity control signal is used for controlling output of the common voltage output driver in pixel units of odd rows and pixel units of even rows, the logic level of the polarity control signal being contrary within two adjacent frames.

9. A driving method of the display panel as claimed in claim 1, the driving method comprising:

generating, by the timing controller, a polarity control signal;

inputting, by the common voltage output driver, a negative common voltage to the first pixel unit based on the polarity control signal, wherein the negative common voltage is adjusted for defective ones of the plurality of pixel units having display defects based on the common voltage adjustment parameter stored by the timing controller;

inputting, by the source driver, a data voltage greater than or equal to the negative common voltage to the first pixel unit in response to the common voltage output driver inputting the negative common voltage to the first pixel unit;

inputting, by the common voltage output driver, a positive common voltage to the first pixel unit at an adjacent frame of the Nth frame based on the polarity control signal, wherein the positive common voltage is adjusted for defective ones of the plurality of pixel units having display defects based on the common voltage adjustment parameter stored by the timing controller; and inputting, by the source driver, a data voltage less than or equal to the positive common voltage to the first pixel unit in response to the common voltage output driver inputting the positive common voltage to the first pixel unit.

10. The driving method according to claim 9, wherein a logic level of the polarity control signal at the Nth frame is contrary to a logic level of the polarity control signal at the adjacent frame of the Nth frame;

wherein the inputting the negative common voltage comprises inputting the negative common voltage to the first pixel unit in response to the polarity control signal being of a high level, and the inputting the positive common voltage comprises inputting the positive common voltage to the first pixel unit in response to the polarity control signal being of a low level; or wherein the inputting the negative common voltage comprises inputting the negative common voltage to the first pixel unit in response to the polarity control signal being of a low level, and the inputting the positive common voltage comprises inputting the positive common voltage to the first pixel unit in response to the polarity control signal being of a high level.

11. The driving method according to claim 10, wherein, the polarity control signal comprises a first polarity control signal for controlling output of the common voltage output driver in pixel units of odd rows and pixel units of even rows, a logic level of the first polarity control signal in the pixel units of odd rows being contrary to a logic level of the first polarity control signal in the pixel units of even rows within the same frame, or the polarity control signal comprises a second polarity control signal for controlling output of the common voltage output driver in pixel units of odd rows and a third polarity control signal for controlling output of the common voltage output driver in pixel units of even rows, a logic level of the second polarity control signal being contrary to a logic level of the third polarity control signal within the same frame, the logic levels of the second polarity control signal and the third polarity control signal being contrary within two adjacent frames.

12. The driving method according to claim 10, wherein the polarity control signal is used for controlling output of the common voltage output driver in pixel units of odd rows and pixel units of even rows, the logic level of the polarity control signal being contrary within two adjacent frames.

* * * * *